US008646634B2

(12) United States Patent
Essebaggers et al.

(10) Patent No.: US 8,646,634 B2
(45) Date of Patent: Feb. 11, 2014

(54) SCREW CAP AND A SPORT CLOSURE CAP WITH INTEGRAL INNER SEAL OPENING MEANS

(76) Inventors: Jan Essebaggers, Foster City, CA (US); Kateryna O. Davydova, Foster City, CA (US)

( * ) Notice: Subject to any disclaimer, the term of this patent is extended or adjusted under 35 U.S.C. 154(b) by 0 days.

(21) Appl. No.: 13/167,598

(22) Filed: Jun. 23, 2011

(65) Prior Publication Data

US 2012/0325769 A1 Dec. 27, 2012

(51) Int. Cl.
*B65D 39/00* (2006.01)
*B65D 5/74* (2006.01)

(52) U.S. Cl.
CPC ..... *B65D 5/748* (2013.01)
USPC ..... 215/297; 220/278; 222/541.2

(58) Field of Classification Search
USPC ..... 215/297, 295, 296, 315, 217, 329, 11.4, 215/311, 228, 257; 220/288, 303, 254, 220/254.1, 278, 212, 256, 255, 277; 222/544, 80, 81, 83, 85
See application file for complete search history.

(56) References Cited

U.S. PATENT DOCUMENTS

| | | | | |
|---|---|---|---|---|
| 3,581,605 | A | 6/1971 | Taylor | |
| 4,634,013 | A | 1/1987 | Bar-Kokhba | |
| 4,709,822 | A | 12/1987 | Vataru | |
| 5,090,582 | A | 2/1992 | Art et al. | |
| 5,702,015 | A | 12/1997 | Giles et al. | |
| 5,709,311 | A | 1/1998 | Butler et al. | |
| 5,797,506 | A | 8/1998 | Lehmkuhl et al. | |
| 6,039,198 | A * | 3/2000 | Wolfe et al. | 215/228 |
| 6,357,628 | B1 | 3/2002 | Long, Jr. | |
| 6,386,385 | B1 | 5/2002 | Amanat et al. | |
| 6,974,045 | B1 | 12/2005 | Trombach et al. | |
| 7,350,666 | B2 | 4/2008 | Essebaggers | |
| 7,410,071 | B1 * | 8/2008 | Seib et al. | 215/228 |
| 7,661,565 | B2 | 2/2010 | Jackman | |
| 7,832,580 | B2 | 11/2010 | Jackman | |
| 7,942,284 | B2 | 5/2011 | Amanat et al. | |
| 8,051,997 | B2 * | 11/2011 | Buckley | 215/230 |
| 8,157,115 | B2 * | 4/2012 | Rho | 215/220 |
| 8,298,103 | B2 * | 10/2012 | Johnson | 474/150 |
| 2003/0230546 | A1 * | 12/2003 | Yurkewicz et al. | 215/251 |

(Continued)

FOREIGN PATENT DOCUMENTS

| | | |
|---|---|---|
| NL | 2001524 | 10/2009 |
| WO | WO 2009/131457 | 10/2009 |

*Primary Examiner* — Robert J Hicks
*Assistant Examiner* — Kareen Rush

(57) ABSTRACT

An integral inner seal opening means within a sport closure cap for containers having a cylindrical mouth opening, for which a tamper evident inner seal with a reinforced rim secures the mouth opening. The closure cap holds a plurality of protrusions, preferably three, extending towards the inner seal, each having cutting edges of which the lower one is at a smaller radius. These protrusions engage with the tamper evident inner seal, when the cap is rotated clockwise, thereby cutting off part of the inner seal rim edge and at the same time cutting three banana shape slots in the inner seal. For single serve beverage bottles with tamper evident inner seal and a sport closure, there is no need to unscrew the cap for opening the inner seal and getting access to the beverage. Initially the reinforced inner seal rim is used to prevent protrusions from accidentally opening the bottle inner seal. The opened seal remains in place while the sport closure is held onto the bottle, by either provisions on the inner seal or by provisions on the closure cap itself.

8 Claims, 9 Drawing Sheets

(56) References Cited

U.S. PATENT DOCUMENTS

| | | | | |
|---|---|---|---|---|
| 2005/0184076 | A1* | 8/2005 | Chang et al. | 220/714 |
| 2005/0263479 | A1* | 12/2005 | Smolko et al. | 215/308 |
| 2007/0029353 | A1* | 2/2007 | Haechl et al. | 222/556 |
| 2007/0102390 | A1* | 5/2007 | Hoepner et al. | 215/235 |
| 2007/0205229 | A1* | 9/2007 | Schmeisser et al. | 222/525 |
| 2008/0041809 | A1* | 2/2008 | Shek | 215/315 |
| 2008/0169261 | A1* | 7/2008 | Druitt et al. | 215/237 |
| 2009/0212061 | A1* | 8/2009 | Naesje | 220/714 |
| 2011/0210149 | A1* | 9/2011 | Essebaggers | 222/544 |

* cited by examiner

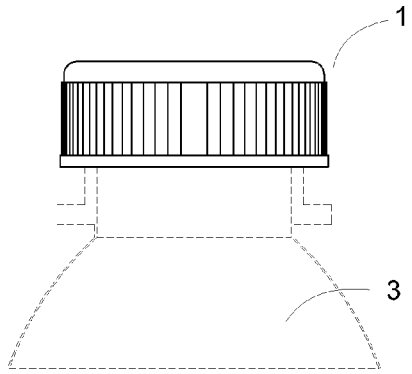
FIG. 1
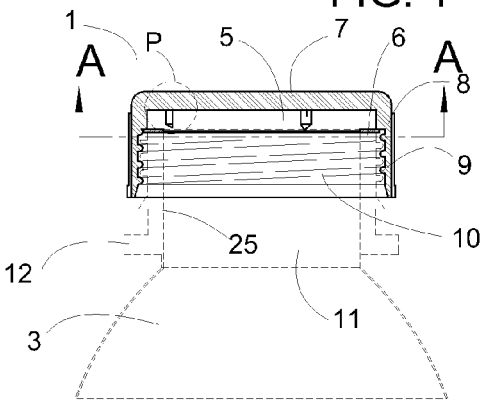
FIG. 2
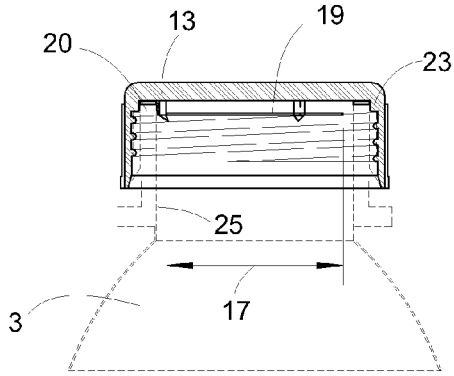
FIG. 3
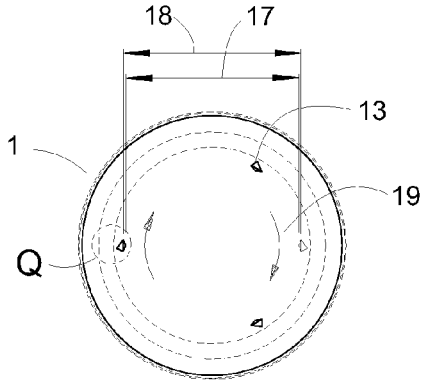
FIG. 4 Cross-section A-A

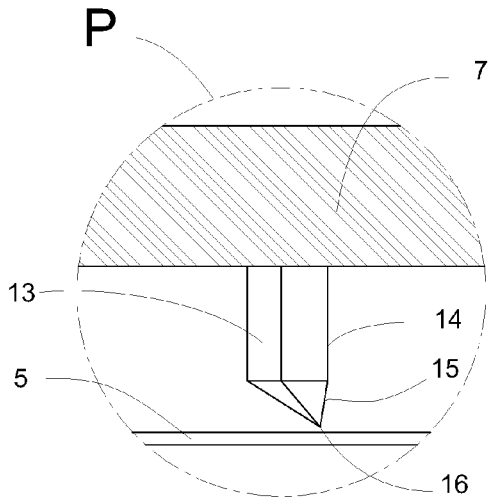
FIG. 5 Enlargement P
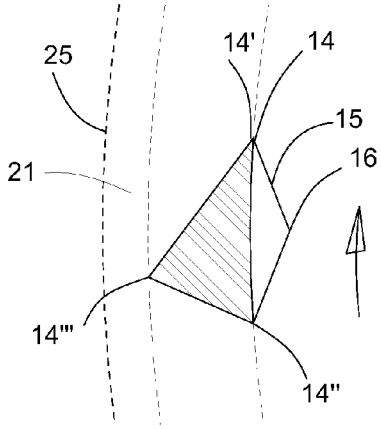
FIG. 6 Enlargement view Q-Q
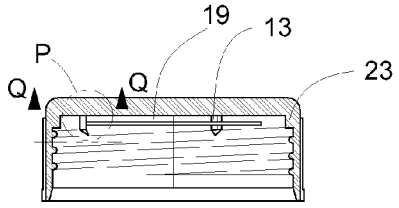
FIG. 7
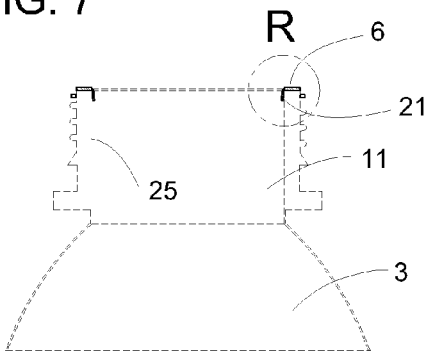
FIG. 8
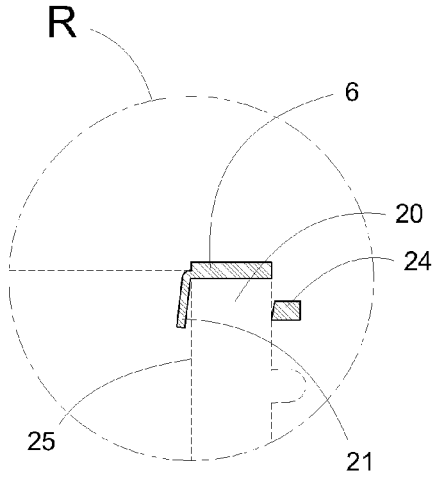
FIG. 9 Enlargement R

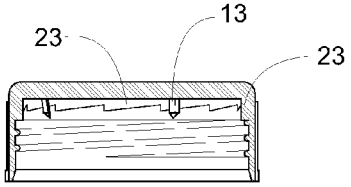
FIG. 10
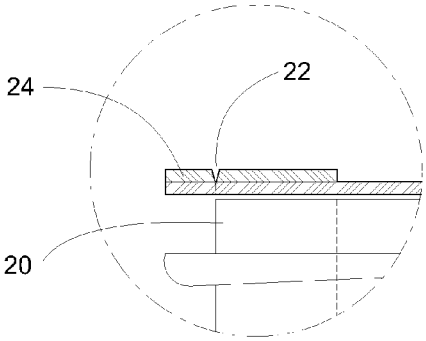
FIG. 12 Enlargement S
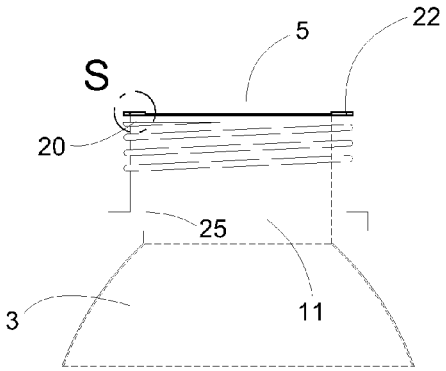
FIG.11
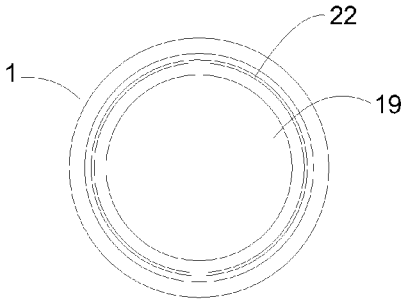
Top view Bottle
FIG. 13

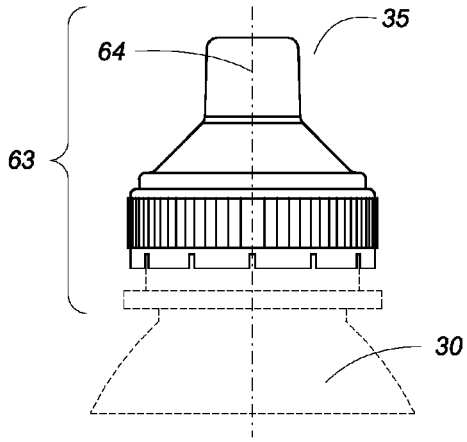
FIG. 14
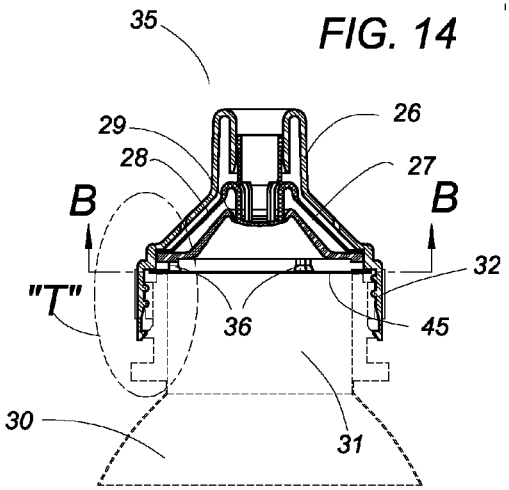
FIG. 15
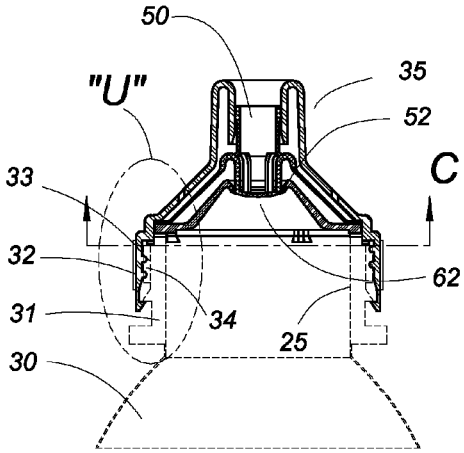
FIG. 16
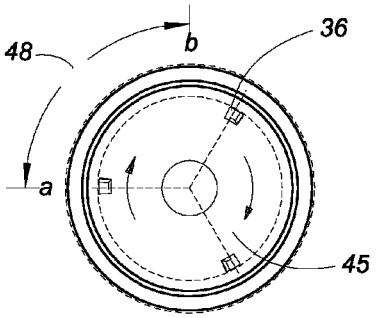
FIG. 17 Cross section B-B
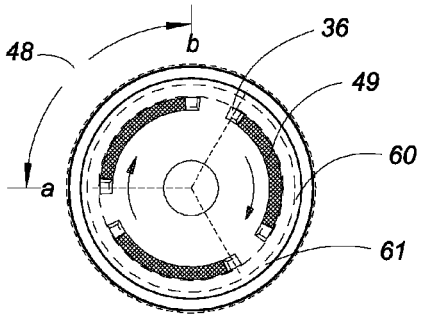
FIG. 18 Cross section C-C

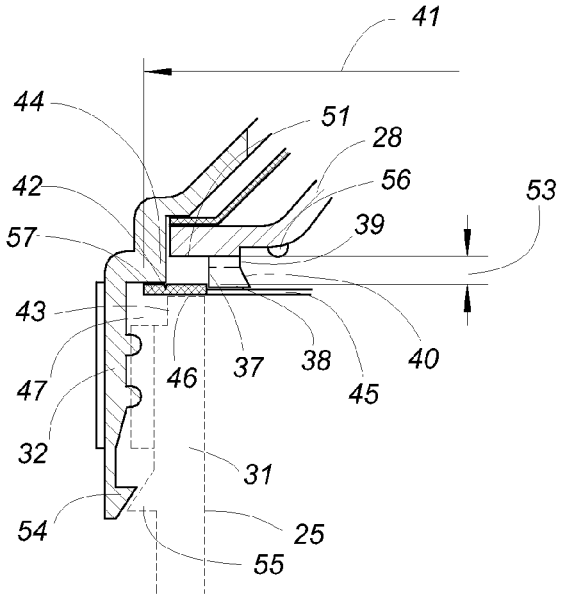
FIG. 19 Enlargement "T"
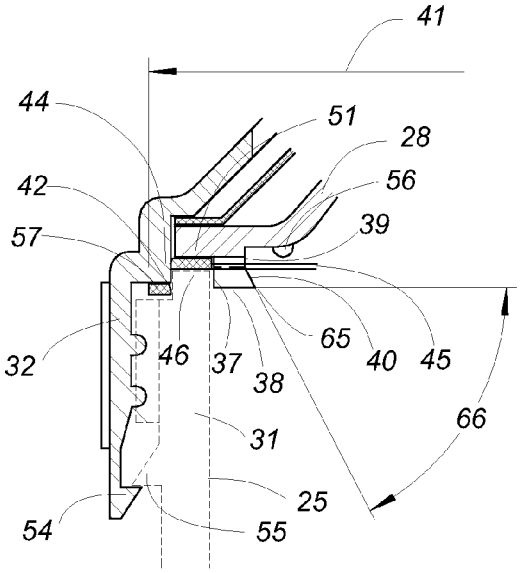
FIG. 20 Enlargement "U"

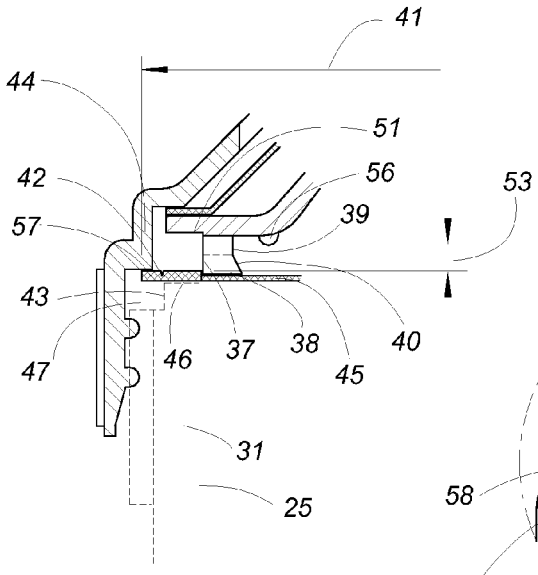
FIG. 24 Enlargement "V"
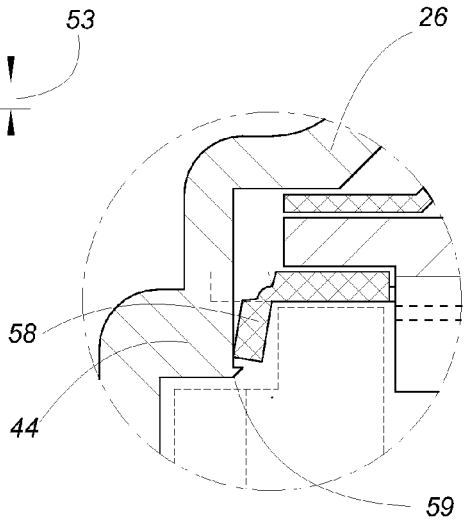
FIG. 26 Enlargement "X"
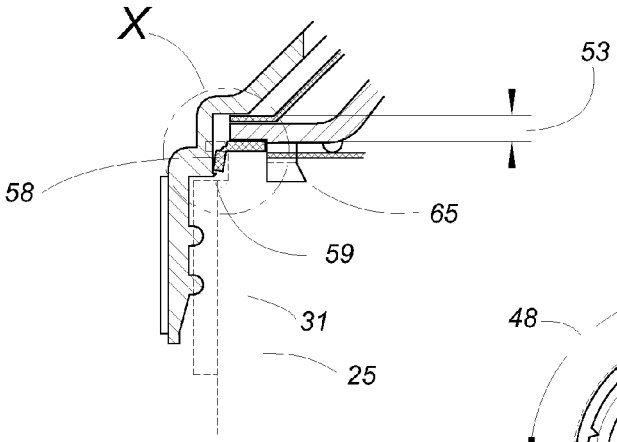
FIG. 25 Enlargement "W"
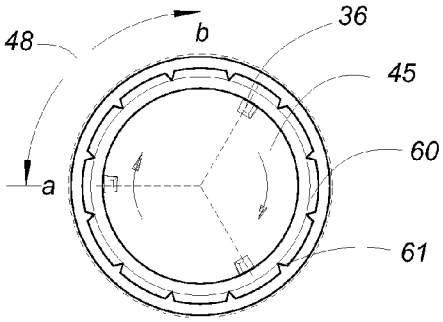
FIG. 27

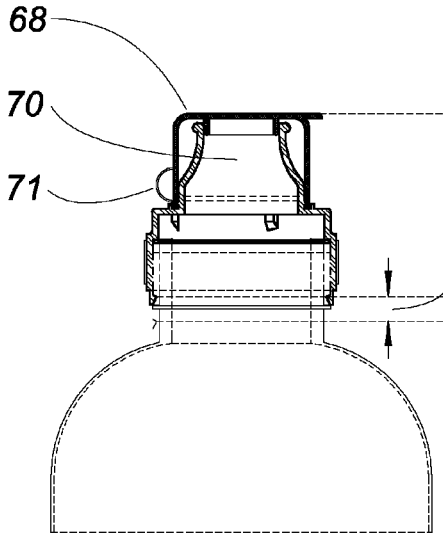
FIG. 32
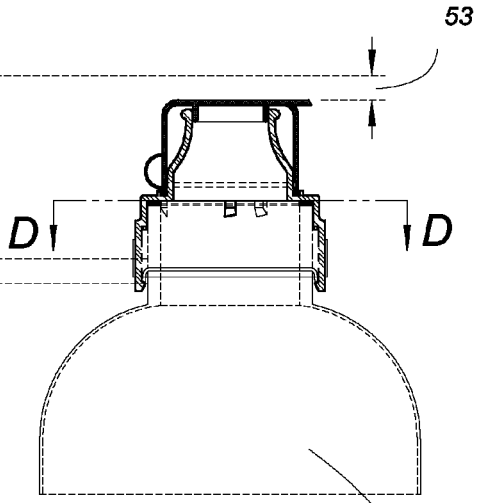
FIG. 33
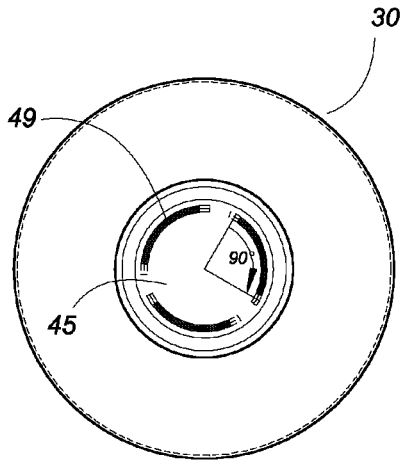
FIG. 34 Cross-section D-D

SCREW CAP AND A SPORT CLOSURE CAP WITH INTEGRAL INNER SEAL OPENING MEANS

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

The present invention relates to an integral tamper evident inner seal (further also called 'inner seal') opening means, placed within a protective threaded plastic closure cap and threaded sport closure caps for various types of rigid and semi rigid containers (example bottles, jars, cans, packaging with a round or cylindrical opening and the like to enable the user to open in an easy and convenient way a tamper evident inner seal, connecting to and covering the mouth opening of the container, and whereby the inner seal itself provide additional means in preventing premature opening of the container.

Nowadays tamper evident inner seals are widely used in food and beverage industry, pharmaceutical, chemical industry, agricultural products, herbicides/pesticides, petro-chemical products, edible oils, lubricating oils, cosmetics and personal care products. This inner seal has a multiple function; a) hermetically closing off the container neck, thereby preventing deterioration of the content by oxidation or contamination and b) provide tamper evidence, that the bottle or container has not been previously opened. This inner seal is usually enclosed by a protective closure cap, screwed or pressed onto the container neck or held within a sport closure cap. The seal assures product integrity and prevents any changes or leakage. It increases the shelf life of container products by keeping the contents free from oxidation and contamination. Tamper evident seals are considered to be safe and hygienic.

Usually a tamper evident inner seal consists of a multi-layer sheet material, such as laminate of paper, polymeric film and/or aluminum foil securely leak and airtight attached to the rim of the mouth opening of the container. In order to get access to the product inside the container, the protective closure, such as a simple plastic screw cap, first needs to be unscrewed from the container neck, after which the tamper evident seal can be manually peeled off or punctured by a finger or sharp object. However, when a tamper evident inner seal is used together with sport closures (example; push pull cap, flip/twist top closure, novel sport closures with or without valve systems, pour spout closures and the like), the sport closure first needs to be unscrewed from the container neck to manually remove and then separately dispose of the inner seal and then screwed back onto the container before the product can be consumed. The prior art patents described herein offer various ways of removing the tamper evident inner seal from the mouth opening of the container.

U.S. Pat. No. 4,634,013 to Bar-Kokhba, shows that the removal of the inner seal can be cumbersome and discloses a means to open this seal by a single cutting devise connected to the cap and also a means that allows rotation of the cap less than 360 degrees. The seal remains hanging in the opening of the bottle, unless manually removed. The cutting devise can be on top or within the cap, thereby cutting a "C" type opening in the inner seal, but with a rotation limit of less than 360 degrees. For this cap, a tamper evident band is required that needs to be removed, before the cap can be further screwed down onto the bottleneck. The method thus described has two disadvantages namely: (1) a tamper evident band needs to be removed before cutting open the inner seal (2) the inner seal either hangs in the mouth opening of the container, or needs to be manually removed. In that case two plastic parts need to be separately disposed. For certain applications this solution may not be suitable where direct skin contact with the product in the container may not be advisable.

Other patent disclosures have been published to remove the inner seal, in a similar way such as described in U.S. Pat. No. 5,090,582 to Art et al. The means described is similar to the patent as described in U.S. Pat. No. 4,634,013 to Bar-Kokhba but with provisions of a ramp to disengage the cutting means from the foil, leaving a "C" type opening in the seal, in such away that the seal will not detach completely. This means is useful but manual removal of the seal as well as a tear away tap will be still required, having the same disadvantages as mentioned in the patent to Bar-Kokhba.

U.S. Pat. No. 5,797,506 to Lehmkuhl et al. discloses a means to open the seal by providing a little nub extending from the upper wall of a screwed-on closure cap. Unscrewing this cap and placing the cap upside down on the bottleneck can open the seal, allowing access to the liquid for consumption. Although there is no need for provisions to cut the seal open for less than 360 degrees, the seal remains hanging in the bottle opening unless manually removed.

U.S. Pat. No. 7,832,580 to Jackman, discloses a tamper evident container closure seal with an integral pull opener. The seal is opened by forcing a finger into the weaker area of the seal void configuration. The broken open center portion of the seal then forms a pull-tab that can be partially connected, which allows the pull-tab to be lifted back out and pulled from the container. This means of seal removal requires manual actions having similar issues mentioned above.

The afore described methods of tamper evident seal removal may be adequate for containers with a protective screw cap, but they pose hygienic and environmental issues, as the inner seal still needs to be removed by hand and disposed separately. Furthermore, those methods cannot be used for more aggressive products inside the container, such as certain type of chemical agents or medicine, where for safety reasons manual contact is not recommended.

U.S. Pat. No. 5,702,015 to Giles adds a pull-tab to the inner closure seal as a way of removal. In this case the seal can be removed without touching the contents of the container but still needs to be manually removed and disposed separately.

U.S. Pat. No. 3,581,605 to Taylor describes a device for removal and disposal of a membrane seal from a plastic bottle by using an annular cutting member and a piercing and extracting member within a separate cap that is placed onto the bottle neck, after the protective cap has been removed. This solution requires a separate cap attached to the closure cap and an extra piercing means.

U.S. Pat. No. 5,709,311 to Butler et al, describes a method and apparatus for removing and storing a container seal on the upper side of a closure seal. In order to remove the seal, the closure cap needs to be removed, turned over and rotated before the seal removing and storing device can be applied.

U.S. Pat. No. 7,942,284 and U.S. Pat. No. 6,386,385 to Amanat et al.; Apparatus for removing tamper-evident seals from containers; provides means to remove a tamper evident seal from a container mouth using a central perforating means that retains the cut out portion of the seal within the cap, preventing it from falling into the container. This centrally perforator means cannot be applied for sport closure caps, as described in the present invention later on. Additionally the cap needs to be turned over to apply the seal removal means.

Other inventions describe various means to remove the tamper evident seal either manually after removal of the closure cap or by retaining the seal by provisions on the outer top side of the closure cap or provide separate seal detaching means, but none address the problems of opening or removing the seal when applied to sport closure caps, without removing a tamper evident band on the outside of the cap first.

The present invention overcomes the disadvantages of the disclosed state of the art techniques by providing a plurality of protrusions with cutting means that can be easily incorporated in the design of the standard threaded closure cap and alternative sport closures, while additional provisions are foreseen as part of the inner seal itself, that prevent the engagement of these cutting means prematurely with the seal. In the case of the alternative sport closures used for single-serve beverage containers together with a tamper evident inner seal, the sport closure cap does not need to be unscrewed from the container to remove or open the tamper evident inner seal for getting access to the product inside, while no external tamper evident band needs to be removed and disposed of.

BRIEF SUMMARY OF THE INVENTION

Problems with the removal of the tamper evident inner seal by hand and the disposal thereof can be overcome with the present invention, whereby a screw cap is provided with a plurality of protrusions or tines with cutting edges, projecting from the inside top cover of the screw cap, equally spaced circumferentially and radially at an equal distance from the centerline but within the inner radius of the mouth opening of the container. These protrusions are pointed downwards, having at least one cutting edge, initially remaining just above the inner seal. The protrusions with one cutting edge are inclined inwardly with the cutting edge tip closer to the centerline of the mouth opening of the container or in another configuration, with straight perpendicular protrusions, having at least two cutting edges, of which the tip of the lower cutting edge is placed closer to the centerline of the closure cap. The minimum number of protrusions for the present invention is one but preferably three. The lower cutting edge of the protrusion with the smaller diameter cuts into the inner seal for only a small distance, while moving downwards through the inner seal. When the closure cap is further screwed down onto the container neck the other cutting edges with a larger diameter take over. In prior art similar protrusions or tines have been used within a closure cap, however whereby a tamper evident band is required, that prevents premature engagement of the protrusions with the inner seal.

For a simple screw cap it is thereby important that adequate access to the contents is obtained through the full opening of the container and whereby it is desirable that the inner seal is completely removed or in the case of a sport closure cap, the inner seal needs only to be partially cut open. In both cases it is imperative that the protrusions don't prematurely engage with the inner seal, which is accomplished by enlarging the inner seal with a few millimeters with a breakaway cut-off rim and by providing cutting means within the closure cap or sport cap to cut off this rim, when access to the container is required. The first option is for a simple screw cap, holding the protrusions within the closure cap the rotation angle of the closure cap is greater than 360 degrees divided by the number of protrusions and the inner seal is completely cut open by forming a disc. As this disc has a larger diameter than the cutting edge tip of the protrusions, it will remain within the plurality of protrusions of the closure cap and simultaneously removed with the cap from the container, whereby the container mouth is now fully opened for drinking or pouring out the contents from the container. This type of arrangement of cutting means within the closure cap can be very useful for chemicals stored in bottles, jars or containers or for medicines not to be touched with bare hands. For a sport closure cap only slots need to be cut into the inner seal, while the sport closure remains on the container neck, meaning that the rotation angle of the closure cap is smaller than 360 degrees divided by the number of protrusions.

In a first preferred embodiment the rim of the inner seal has been enlarged in diameter and reinforced, while in the closure cap additional cutting means are provided to cut off part of the inner seal rim, when opening the container. This enlarged rim allows eliminating the tamper evident band of the earlier described prior art embodiments.

A second embodiment and/or application of the present invention is for closures designed especially for on-the-go consumption held in single-serve bottles, closed off with a push pull cap or other novel sport closures. As mentioned before an inner seal has been provided in the shape of a thin disc made of plastic, paper or aluminum foil, with reinforced rim, glued or hot welded to the rim of the mouth opening of the bottle or container, which cannot easily removed manually. Hereby the sport closure with protrusions is designed in such way that the tamper evident inner seal is opened only partially when the sport closure is rotated clockwise and moves further downwards onto the container neck, after cutting off part of the inner seal rim. In this case the rotation angle should be less than 360 degrees divided by the number of protrusions in the closure, thereby cutting a multiple of banana shape slots into the inner seal at the inner circumference of the mouth opening of the bottle or container neck. The cross-sectional flow area of all slots together, however, shall be adequately large, to allow the contents of the container to pass easily when being consumed. There is no need for removing the sport closure from the container at all, in order to get access to the product and even can be designed in such away that the sport closure cap remains permanently attached to the bottle. As there is no need to remove the tamper evident inner seal manually, it thus enhances the hygienic use of the product and eliminates the need for manual disposal of the inner seal.

In a third embodiment the sport closure cap has been slightly altered allowing the extended part of the enlarged inner seal to be bent over the rim of the bottleneck, thereby providing means for keeping the sport closure to remain on the bottle, after cutting open the inner seal In summary: To assure that the cutting means, in the described embodiments above, don't cut open prematurely the tamper evident inner seal, a number of preventive means are disclosed, which are part of the present invention. In order to accomplish this, the rim of the inner seal is enlarged and reinforced, providing an initial stop for the closure cap, preventing the engagement of the cutting protrusions with the inner seal. This enlarged portion of the inner seal rim breaks off or bends over the edge of the rim of the bottleneck, when the closure cap is further screwed down. For single serve bottles, the sport closure will remain on the bottle.

OBJECTIVES OF THE PRESENT INVENTION

The first objective of the present invention is to open a tamper evident inner seal that closes off the mouth of a container with a cylindrical threaded neck, thereby overcoming the disadvantages of prior art inner seal opening methods and to provide an efficient and convenient way for the consumer to remove the tamper evident inner seal, used together with a screw cap or sport closure cap. The improved inner seal opening means can be easily incorporated into existing designs of afore mentioned closure caps, while there is no need for manual removal and disposal of the inner seal.

A second objective of the present invention is to provide means to keep the screw cap or sport closure at an initial position, thus preventing the engagement of the cutting means incorporated within closure caps, from cutting open the tamper evident inner seal prematurely, without the use of a tamper evident band.

A third objective of the invention is to open a sealed container hygienically, whereby there is no need to touch the inner seal with the fingers of one's hand and whereby the cut open part of the inner seal does not fall into the container.

A fourth objective of the invention is to provide the possibility of resealing the container after removal or opening of the inner seal.

A fifth objective of the invention is to provide a method of removing or opening the inner seal for sport closures (such as a push pull cap, flip/twist top closure, sport closures with or without valve system, pour/open spout closures and the like), whereby the inner seal can be inspected on integrity, before the bottle is opened.

A sixth objective of the invention relates to sport closures for single-serve bottles by providing means to keep the sport closure attached to the bottleneck after the inner seal has been opened. In this way the inner seal, the sport closure and the bottle are disposed of together as a complete unit.

A seventh objective of the invention relates is to cut open and remove the inner seal completely from the mouth opening of the container with a simple screw cap, thereby having the full opening of the mouth available for pouring out the contents of the container.

An eighth objective of the present invention is to provide a means to eliminate the tamper evident band that needs to be separately disposed.

A ninth objective is to provide a tamper evident inner seal with a reinforced rim for keeping the closure cap at an initial position, prior to cutting the inner seal open in the weaker central part.

BRIEF DESCRIPTION OF SEVERAL VIEWS OF THE DRAWING

FIG. 1 is a front view of a first preferred embodiment and application of the present invention for a threaded closure cap, screwed onto a container neck, holding a tamper evident inner seal with a breakaway collar.

FIG. 2 is a vertical cross-sectional view of FIG. 1 showing inside the cap the circumferentially spaced plurality of protrusions with cutting edges extending downwards just above the tamper evident inner seal, prior to opening the inner seal, and the breakaway collar still in tact.

FIG. 3 is a vertical cross-sectional view of FIG. 1 with the breakaway collar cut off and the closure cap rotated clockwise to its lowest position, while the inner seal, covering the opening of the bottleneck, has been cut open and of which a disc shape center part is held within the protrusions.

FIG. 4 is a horizontal cross-section A-A of FIG. 2, showing a plurality of protrusions within the closure cap.

FIG. 5 is an enlarged detail "P" of FIG. 2 showing a single protrusion with two cutting edges.

FIG. 6 is an enlarged detail "Q" of FIG. 4 and view Q-Q of FIG. 7 showing the cutting edges of a single enlarged protrusion of FIG. 5 as a top view cross-section thereof.

FIG. 7 shows the closure cap of FIG. 1 unscrewed from the bottle and holding inside the removed inner seal from the bottle opening, which remains within the confinement of the protrusions.

FIG. 8 shows the bottle in the opened position, with part of the inner seal bent over the edge of the bottleneck rim, and breakaway part removed.

FIG. 9 shows an enlarged detail "R" of FIG. 8.

FIG. 10 shows a vertical cross-section of a cap with a ratcheting cutting edge and inclined protrusions.

FIG. 11 shows a front view of a tamper evident inner seal, being a first preferred embodiment, with a reinforced rim but a weakening circumferential cut at the outer rim edge of the container/bottleneck of which an enlarged detail "S" is shown in FIG. 12.

FIG. 12 is an enlarged detail "S" of the container/bottleneck of FIG. 11.

FIG. 13 shows atop view of FIG. 11.

FIG. 14 shows a front view of a second preferred embodiment and application of the present invention for a sport closure with a valve, illustrated for the Self Regulated Spout (SRS) closure cap, with provisions on the lower part of the cap to secure the SRS closure cap to the bottle.

FIG. 15 shows a vertical cross-section of FIG. 14 with the tamper evident inner seal of FIG. 11 unopened.

FIG. 16 shows a vertical cross-section of FIG. 14 with the SRS closure fully screwed down onto the bottleneck and whereby the rim of the inner seal has been cut loose and the central part of the inner seal has been cut open.

FIG. 17 is a horizontal cross-section B-B of FIG. 15 prior to opening the inner seal.

FIG. 18 is a horizontal cross-sectional view C-C of FIG. 16 showing the cut open flow area, when the cap is provided with three protrusions and rotated clockwise over an angle of 90 degrees.

FIG. 19 shows an enlarged cross-sectional view "T" of a portion of FIG. 15 illustrating details of the present invention for the second preferred embodiment for sport closures with the closure cap in its initial position and the tamper evident inner seal unopened.

FIG. 20 shows an enlarged cross-sectional view "U" of a portion of FIG. 16 illustrating details of the present invention for the second preferred embodiment for sport closure with the tamper evident inner seal cut open.

FIG. 24 shows an enlarged cross-section "V" of a portion of FIG. 22, illustrating details of the present invention for the third preferred embodiment for sport closure with the closure cap in its initial position and the inner seal unopened.

FIG. 25 shows an enlarged view "W" of FIG. 23, illustrating details of the present invention for the third preferred embodiment with part of the rim of the inner seal bent over the edge of the bottleneck and the inner seal opened.

FIG. 26 shows a further enlarged cross-sectional view "X" of FIG. 25.

FIG. 27 shows a top view of an improved flexible tamper evident inner seal reinforced rim with a plurality of cuts in the outer rim with bent over lips.

FIG. 32 shows a front view of the invention for an open spout closure, using a dust cap to close the bottle after removal or opening of the inner seal.

FIG. 33 shows a vertical cross-section of FIG. 32.

FIG. 34 shows a top view of FIG. 32, with three banana shape openings in the tamper evident inner seal, without spout closure cap.

DETAILED DESCRIPTION OF THE INVENTION

Figure 21:
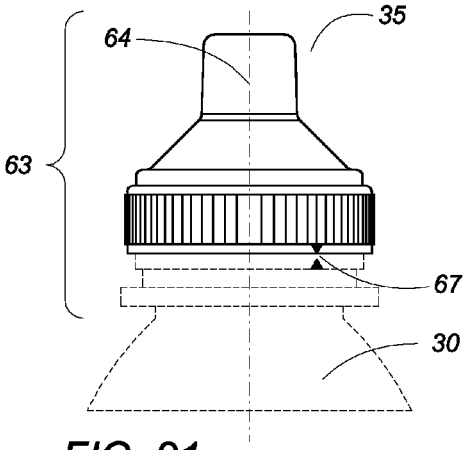
FIG. 21 shows a front view of a third preferred embodiment and application of the present invention for a sport closure with a valve, illustrated for the Self Regulated Spout (SRS) closure cap, with special provision on the rim of the inner seal, to secure the SRS closure cap to the bottle.

With reference to the drawings of FIGS. 1-13, a first preferred embodiment and application of the present invention is shown for a conventional plastic threaded closure cap, provided with cutting protrusions or tines, screwed onto a bottle- or container with a bottle-/container-neck, secured by a leak-proof and airtight tamper evident inner seal (further also called 'inner seal') 5. The closure cap is also provided with an inner cutting means 23 in the form of protrusions, that cuts an overhanging portion or breakaway collar 24 of the inner seal before the cutting protrusions or tines reaches the surface of the inner seal, and opening the inner seal thereby getting access to the contents of the bottle.

FIG. 1 shows a front view of this first embodiment for the threaded closure cap 1, screwed onto a bottleneck having a cylindrical mouth opening 11 of bottle 3 in its initial/unopened position, whereby the screwing down of the cap is blocked by the overhanging breakaway collar 24 of FIG. 12. FIG. 2 shows a vertical cross-section of FIG. 1, in the unopened position, while FIG. 3 shows a vertical cross-section of FIG. 1 after cracking the breakaway collar 24 of the inner seal rim 6, allowing the closure cap to be screwed downward onto the bottleneck 11 to its lowest position until stopped by collar 12 or by the bottleneck rim 20. The closure cap consists of a top wall in the shape of a disc 7 integrally connected to a cylinder 8, with female threading 9 inside, screwed over a male threading 10 of bottleneck 11. The inner seal 5, as illustrated in FIG. 2, consists generally of a multi-layer plastic, paper and/or aluminum foil disc, with a relative stiff rim 6 of which the lower side, at its periphery, is attached by gluing or thermal welding to the bottleneck rim 20, being the top surface area between the inside and outside diameter of the bottleneck 11.

The closure cap is provided with a plurality of cutting protrusions 13 (with a minimum number of one, but preferably three), circumferentially placed and integrally connected to the lower side of the disc 7 at the inside of closure cap 1, at a diameter somewhat smaller than the inside diameter of the bottleneck mouth opening 25, positioned in downward direction towards the opening of the bottleneck, but initially remaining slightly above the inner seal 5. This position of the closure cap with the protrusions 13 above the inner seal is held until the breakaway collar 24 is cracked and the closure cap can be further screwed down onto the bottleneck.

After cracking collar 24 of FIG. 12 and screwing down the closure cap further onto the bottleneck 11, the protrusions 13 will now engage with the inner seal 5, by rotating the closure cap clockwise. The protrusions 13 of FIGS. 2-4 with details shown in FIGS. 5 and 6, are provided with cutting edges 14 and 15, of which 15 ends up in a sharp pointing edge 16, having a smaller diameter 17 than cutting edge 14 at a diameter 18 (see FIG. 4 detail Q and cross-sectional view A-A of FIG. 2). As the protrusions 13 move in two directions; namely rotationally and axially, the cutting edge 15 with the sharp tip 16, is only for a small circumferential distance involved in the cutting operation of the inner seal 5 at the smaller diameter 17. After that the cutting edge 15 is no longer in use and the further cutting of the inner seal is taken over by cutting edges 14 with a larger diameter 18.

While rotating the closure cap 1 clockwise, circumferential slots are being cut into the inner seal 5, at the inside of the bottleneck 11 initially at a diameter 17 and later at a diameter 18. If the rotation angle of the closure cap 1 is greater than 360 degrees divided by the number of protrusions, a disc type part 19 of the inner seal will be cut loose from the inner seal 5. As the diameter of this inner disc of the seal is larger than the diameter of cutting edges 15 with a tip 16, disc 19 will stick between the protrusions 13 and can be removed from the bottleneck together with the closure cap, thereby opening the bottle or container. In FIGS. 8 and 9 the remaining inner portion 21 of rim 6 as part of inner seal 5 that hangs over the bottleneck rim 20 is pushed against the inside wall of the mouth opening 25 of the bottleneck 11 by the triangular cross-sectional shaped protrusions with corners 14', 14" and 14'" of FIG. 6, so that no cutting remains will fall into the bottle or container and the inside wall of the mouth opening 25 of the bottle is fully opened. Thus described; a bottle having an inner seal with an enlarged overhanging breakaway collar and a closure cap with an integral opening means in the form of a plurality of protrusions, can be opened without the need of manually removing the inner seal after opening the bottle as shown in FIGS. 7 and 8. This means of opening an inner seal can be important in particular, when skin-contact with the contents of the bottle should be prevented, as with chemicals or certain type of medicines.

FIG. 10 shows a cap with a plurality of inwardly inclined protrusions 13 provided with circumferential cutting means 23, which may either have a continuous sharp edge or edges in the shape of saw teeth. The protrusions 13 are of the same type as described before, however with cutting edge 14 and 15 combined to one cutting edge but having an inclination towards the centerline 64 of the bottleneck with the tip 16 at the smallest diameter (not shown). The rim outside diameter of the inner seal is hereby 1 to 3 mm larger than the outside diameter of the bottleneck 11 with a breakaway portion 24 of FIG. 12 that hangs over the edge of bottleneck rim 20 of bottleneck 11. FIG. 13 is herein a top view of the bottle of FIG. 11 with the inner seal in place. The rim 24 of the inner seal 5 has been reinforced, by using stronger materials or is extra laminated, but at the same time weakened by a circumferential carve or slit 22 right at the edge of bottleneck rim 20 of the bottleneck 11. This overhanging portion 24 serves two purposes; (1) to function as a stop position of the closure cap whereby the extra cutting means 23 of the closure cap touches this overhanging portion 24, keeping the protrusions 13 from reaching the inner seal 5; and (2) when the bottle needs to be opened, the closure cap is further screwed down onto the bottleneck 11, thereby cutting off portion 24, while at the same time the inner seal 5 is being cut open by the protrusions 13. The application of an enlarged inner seal is further described in the second and third embodiment.

Figure 29:
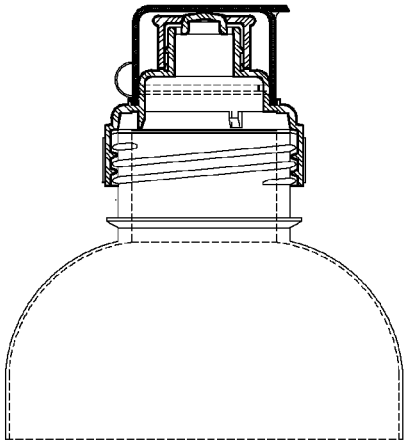
FIG. 29 shows a vertical cross-section of FIG. 28.
Figure 30:
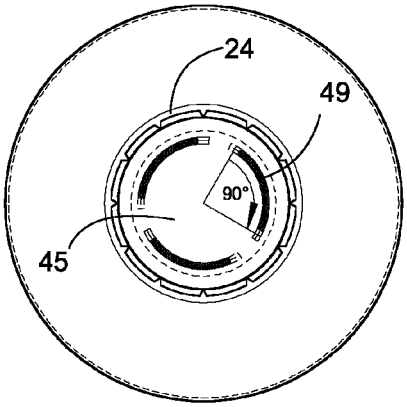
FIG. 30 shows a top view of the bottle opening with three-banana shape cuts in the tamper evident inner seal of which a front view is shown in FIG. 31.
Figure 31:
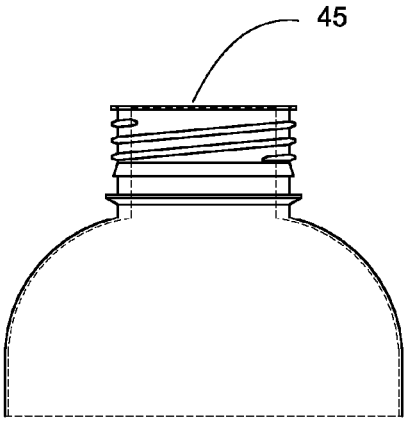
FIG. 31 shows a partial front view of a bottleneck from which the push pull cap of FIG. 28 has been removed.

A second embodiment and application of the present invention shows a closure system 63 in FIGS. 14-20, for flexible, semi flexible and soft bottles or containers 30, in which the cutting protrusions 13 with cutting edges 14 and 15 of FIGS. 5 and 6, are applied to alternative sport closures (FIGS. 14, 29 and 32) with among others a valve system such as a "Self Regulating Spout" (SRS) closure cap to Essebaggers in U.S. Pat. No. 7,350,666 and as further described in Dutch patent 2001524 and PCT application WO2009/131457. The SRS closure cap assembly 35 of FIG. 14 and as further illustrated in vertical cross-section of FIGS. 15 and 16, consists of a spout 26, holding a membrane 27 with an integrated valve 29, that closes off a centrally located flow through orifice 62, having a valve seat 52 in a valve-retaining element 28, which as a unit (assembly) 35 is screwed onto a bottle or container 30, having a bottleneck/container neck 31. Spout 26 is thereby integrally connected to a cylindrical part 32 holding female threading 33, which is screwed onto bottleneck 31 with male threading 34. The valve-retaining element 28, being an integral part of the SRS closure cap assembly 35, is rotationally fixed to spout 26. This valve-retaining element 28 is provided with a plurality of cutting protrusions or tines 36, (preferably three but with a minimum of one), having preferably a somewhat different shape as the protrusions 13 of FIGS. 5 and 6 and of which an enlargement views "T" and "U" of FIGS. 15 and 16 is shown in FIGS. 19 and 20, with the inner seal unopened and opened respectively. These protrusions have two vertically oriented cutting edges 37 and 39, one lower cutting edge 38 radially oriented and one cutting edge 40 under an angle 66 relative to the centerline 64, in such a way that the tip 65 at the intersection of cutting edge 38 and 40 has a smaller diameter than cutting edge 39. The tamper evident inner seal 45 of FIG. 15 has a slightly larger diameter 41 (e.g. 1 to 3 mm) than the rim of the bottleneck 31 and is reinforced relative to the remainder of inner seal 45 having a circumferential carve or slit 42 right at the outer diameter of the bottleneck rim 43, similar to the carve 22 as shown in FIG. 12. The SRS closure cap assembly 35 is screwed onto the bottle- or container-neck 31 until the cylindrical boss 44, as part of spout 26, reaches the reinforced overhanging rim 46 of the enlarged inner seal 45. The SRS closure cap assembly 35 is initially in this position and as such delivered to the consumer. If someone wants to inspect that the contents of the bottle has not been opened before, the SRS closure cap assembly 35 can still be removed from the bottle and inner seal 45 can be inspected. In general, however, the consumer will not inspect inner seal 45 prior to drinking and the SRS closure cap assembly 35 will be further screwed down onto the bottleneck, whereby the protrusions 36 engage in cutting the inner seal 45 open, while at the same time a piece of the outer diameter of inner seal 45 breaks off, forming a ring from overhanging portion 57 that drops down into the hollow space or cavity 47. The SRS closure cap assembly 35 can be rotated over an angle 48 of FIGS. 17 and 18, smaller than 360 degrees divided by the number of protrusions, which angle is smaller than 120 degrees, (preferably 90 degrees) in the third preferred embodiment, having only three protrusions 36. In this case the three protrusions 36 cut three banana shape slots 49 in inner seal 45, of which the flow through area shall be larger than the cross-sectional flow through area 50 of the spout 26. By rotating the SRS closure cap assembly 35, the closing rim 51 as integral part of valve-retaining element 28 in FIGS. 19 and 20 moves downwards onto the rim of the inner seal 45, which is thermally welded or glued to the rim of the bottleneck 31, while the protrusions 36 rotate over an angle 48 and at the same time move downwards over a distance 53. Alternatively the rotational angle 48 can be more than 360 degrees divided by the number of protrusions 36. In that case a disc is cut from inner seal 45 in a similar way as described in the previous preferred embodiment of FIGS. 1-4. In that case some measures need to be taken or provisions added, that this disc does not close off the flow of fluid to the spout, by providing three or more stubs 56 on the valve-retaining element 28. For this third embodiment it might be desirable that the SRS closure cap assembly 35 remains attached to the bottle container after inner seal 45 has been cut open. Provisions can be made to the lower part of cylinder 32 to accomplish this by adding provisions 54 in the form of small hooks on the inside circumference of the lower part of cylinder 32, that engages with a bottle ring/collar 55 of the bottleneck 31 when the SRS closure cap assembly 35 is further screwed down. After engagement of these hooks with the bottle ring 55, the spout assembly cannot be separated from the bottle anymore, without exerting a large force on the SRS closure cap assembly. Instead of hooks on the lower part of cylinder 32, ratcheting means can be applied between the bottleneck and the SRS closure cap assembly 35, whereby the bottle ring 55 has a circumferential saw tooth arrangement that engages with a saw tooth or other means at the inside of cylindrical lower part 32 of FIGS. 19 and 20, not further described in this patent application. The afore described second preferred embodiment of the present invention, is particularly interesting for situations where no parts are to be disposed separately, other than together with the bottle or where contacts with the contents of the container is not desirable.

Figure 22:
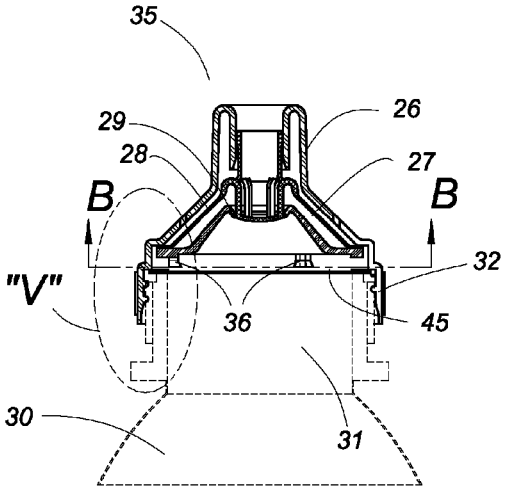
FIG. 22 shows a vertical cross-section of FIG. 21 with the tamper evident inner seal of FIG. 11 unopened having a reinforced rim, as depicted in FIG. 12.
Figure 23:
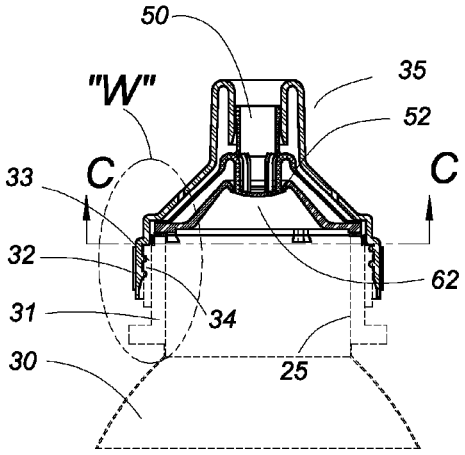
FIG. 23 shows a vertical cross-section of FIG. 21 with the SRS closure fully screwed down onto the bottleneck and whereby the rim of the inner seal has been bent over the edge of the bottleneck and the central part of the inner seal has been cut open.
Figure 28:
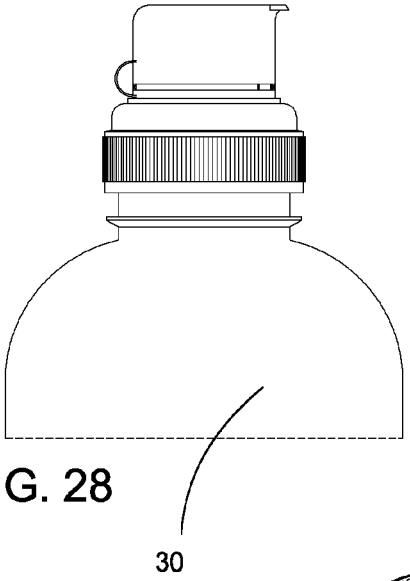
FIG. 28 shows a front view of the invention for a push pull cap application.

Another option is a third embodiment to keep the closure cap with the bottle is shown in FIG. 21-23 of which details are shown in FIGS. 24-27 respectively. In this case the overhanging portion or extended rim part 60 of the inner seal, can act as a means that prevents the closure cap from unscrewing from the bottle, whereby this extended rim part 60 bends over the edge of the container-/bottleneck rim 31, thereby getting in position 58. An added small circumferential edge 59, extending inwardly from the inside of the cylindrical boss 44 as integrated part of spout 26, will prevent the removal of the SRS closure cap assembly 35 of which a further enlarged detail "X" of FIG. 25 is shown in FIG. 26. This embodiment requires however, a strong bond between the rim of the inner seal 45 and the rim of the container-/bottleneck 31. The bottle ring 55 and provisions 54 on the SRS closure cap assembly of FIGS. 19 and 20 can than be omitted. If so required a plurality of radial cuts 61 in the overhanging portion 57 can be made, forming extended rim parts 60 in the form of small lips, to enhance the flexibility of the rim extensions 60 as shown in FIG. 27.

Alternative applications of the present invention to open an inner seal, can be used for other sport closures with a spout such as the push pull cap (FIG. 29) caps with a valve, rotational open/close caps and screw caps with pour spout closure 70, holding a dust cap 68 with a hinge 71. For all of these applications an inner seal will be required, when the contents in the bottle can rapidly deteriorate by exposing it to ambient air for a long time during storage or in preventing contamination by dirt or bacteria. Example for the mentioned applications are shown in FIGS. 28-34, using similar protrusions within the closure cap to open an inner seal, as described before.

By eliminating the tamper evident band of the afore mentioned embodiments and applications, is could be useful to provide visual means or marks 67 on the outside of the closure cap that the cap was rotated clockwise and opened the inner seal. Two provisions can be made to show that the contents of the bottle has been accessed (a) A visual mark 67 on the cap showing the open/close position relative to the bottleneck and (b) A dust cap 68 (with or without hinge 71) with tamper evident closure means, as commonly used in the industry (not shown on the drawings).

What is claimed is:

1. A 'closure system' for opening a tamper evident inner seal, secured onto a container with a container neck having a cylindrical mouth opening, comprising:

a) a tamper evident inner seal in the shape of a disc, having an upper and lower surface and a reinforced rim with an overhanging portion, of which the lower surface is securely, leak and air tight attached to the rim of said container neck; and b) closure cap assembly consisting of a closure cap with a spout and a cylindrical part with a female threading inside, connected to a male threading of said container neck, holding a valve-retaining element with a centrally located flow through orifice closed off by a valve, which is activated by a membrane; and c) said closure cap assembly is screwed down onto said container neck secured by said tamper evident inner seal until stopped by an internal cylindrical boss, which is part of said closure cap and by the overhanging portion of said tamper evident inner seal; and d) said closure cap assembly is internally provided with a plurality of cutting protrusions or tines pointing downwards, initially remaining just above said tamper evident inner seal; and e) said protrusions are equally circumferentially spaced at a diameter somewhat smaller than the inside diameter of said mouth opening; and f) said protrusions have a plurality of cutting edges, with a lower cutting edge intersecting with a cutting edge under an angle inwardly, forming a cutting edge tip towards the centerline of said mouth opening; and g) said valve-retaining element is rotationally fixed to said closure cap; and h) said tamper evident inner seal is weakened by a carve or slit circumferentially therein right at the edge of the outside rim diameter of said container neck; and i) said cylindrical part of said closure cap is provided at the lower side with provisions preventing the closure cap assembly from being removed, after the closure cap assembly is screwed further down onto said container neck, whereby said internal cylindrical boss cuts off the overhanging portion of the reinforced rim of said tamper evident inner seal, which is then in the shape of a ring that remains within a hollow space that exists between the cylindrical part of said closure cap and said container neck; and j) said provisions of the cylindrical part can be in the shape of small hooks positioned inside at its lower part and which interlock with a ring or collar, which is part of said container neck or can be of a ratcheting arrangement therewith in such a way that allows said closure cap assembly to rotate clockwise only (not shown).

2. The closure system of claim 1, wherein said plurality of protrusions cuts a circular disc into said tamper evident inner seal, when said closure cap assembly is rotated over an angle larger than 360 degrees divided by the number of protrusions, and whereby the disc stays within the boundaries of said protrusions, while stubs are foreseen at the inside of said valve-retaining element to assure that the fluid flow to the spout is not hampered by this disc.

3. The closure system of claim 1, wherein said plurality of protrusions cuts banana shape slots into said tamper evident inner seal, when said closure cap assembly is rotated over an angle less than 360 degrees divided by the number of protrusions, and whereby a total flow through area of a banana shape slots is equal to or larger than the cross-sectional flow through area of the spout.

4. The closure system of claim 1, wherein said tamper evident inner seal in combination with said cutting protrusions applicable to sport closures with a spout.

5. The closure system of claim 1, wherein said tamper evident inner seal in combination with said cutting protrusions, applicable to a conventional plastic threaded closure cap, whereby said closure cap is removed together with the cut out disc of said tamper evident inner seal, in order to get access to the contents of said container.

6. The closure system of claim 1, wherein said overhanging portion of said tamper evident inner seal is provided with a plurality of radial cuts forming extended rim parts or lips that allow the extended rim part or lips to bend over the edge of a container neck rim in such away that it prevents the closure cap assembly from unscrewing from said container neck by a circumferential edge extending inwardly from said cylindrical boss.

7. The closure system of claim 1 provided with visual means or marks, showing an open/close position of said closure cap assembly relative to said container neck.

8. The closure system of claim 1 applicable to rigid and flexile bottles and containers.

* * * * *